US008359780B2

(12) United States Patent
Peterson et al.

(10) Patent No.: US 8,359,780 B2
(45) Date of Patent: Jan. 29, 2013

(54) ANYPOINT PICATINNY RAIL BIPOD/TRIPOD MOUNT

(75) Inventors: Morris Peterson, Earlysville, VA (US); Matthew Warren Charles Peterson, Crozet, VA (US); Charles Robert Overbey, Jr., Deland, FL (US); William E. S. McCormick, Bluff City, TN (US); Gary Vance, Bristol, VA (US)

(73) Assignee: Ashbury International Group, Inc., Ruckersville, VA (US)

( * ) Notice: Subject to any disclaimer, the term of this patent is extended or adjusted under 35 U.S.C. 154(b) by 103 days.

(21) Appl. No.: 12/828,176

(22) Filed: Jun. 30, 2010

(65) Prior Publication Data

US 2012/0144717 A1 Jun. 14, 2012

Related U.S. Application Data

(60) Provisional application No. 61/221,592, filed on Jun. 30, 2009.

(51) Int. Cl.
*F41C 27/00* (2006.01)

(52) U.S. Cl. ..... 42/94

(58) Field of Classification Search ..... 42/124, 42/127, 90, 94, 125; 396/428; 248/187.1, 248/176.3, 177.1
See application file for complete search history.

(56) References Cited

U.S. PATENT DOCUMENTS 3,877,166 A * 4/1975 Ward ..... 42/127
6,442,883 B1 * 9/2002 Waterman et al. ..... 42/124
6,773,172 B1 * 8/2004 Johnson et al. ..... 396/428
6,931,778 B1 * 8/2005 Nelson et al. ..... 42/120
7,077,582 B2 * 7/2006 Johnson ..... 396/428
7,562,485 B2 * 7/2009 Newhall et al. ..... 42/127
7,823,316 B2 * 11/2010 Storch et al. ..... 42/90
2007/0163163 A1 * 7/2007 Munst ..... 42/85
2008/0178511 A1 * 7/2008 Storch et al. ..... 42/90

* cited by examiner

*Primary Examiner* — Michael Carone
*Assistant Examiner* — Reginald Tillman, Jr.
(74) *Attorney, Agent, or Firm* — Troutman Sanders LLP; Robert R. Elliott, Jr.

(57) ABSTRACT

Various detachable firearm mounting bracket device embodiments are provided. According to an embodiment, a detachable mounting bracket is adapted to allow users of various weapons platforms and support devices to rapidly and securely attach support devices, e.g., bipods and tripods, to a firearm in tandem. A detachable mounting bracket can comprise a housing to attach to a firearm forend, a clamping mechanism to secure the housing to a firearm, and a rail interface adapted to receive a plurality of adapters. The detachable mounting bracket device can be attached to a firearm with a clamp, screw closure, and a vertical interlock clamp. After the detachable mounting bracket is attached to a firearm, a user can easily and rapidly secure a support device to the rail interface using a plurality of adapters. Other aspects, features, and embodiments are also claimed and described.

11 Claims, 5 Drawing Sheets

ANYPOINT PICATINNY RAIL BIPOD/TRIPOD MOUNT

CROSS-REFERENCE TO RELATED APPLICATION & PRIORITY CLAIM

This application claims priority to and the benefit of U.S. Provisional Patent Application No. 61/221,592, filed 30 Jun. 2009, which is incorporated herein by reference in its entirety as if fully set forth below.

TECHNICAL FIELD

Embodiments of the present invention relate generally to firearms, and more particularly, to detachable mounting brackets that enable a plurality of accessories, including field stabilization systems, to be rapidly and securely attached to firearms, and in particular, long guns. Specifically, embodiments of the present invention relate to detachable mounting brackets that enable bipods and tripods to be rapidly and securely attached in tandem to long guns.

BACKGROUND

Many people have long utilized firearms to shoot projectiles of various sorts. For example, military personnel, law enforcement officers, hunters, and precision target shooters use different types of firearms (or weapons platforms) for different purposes. Commonly, people use firearms, including long guns, in conjunction with a bipod, to assist them in acquiring steadying their aim on a target and to prevent shooter fatigue in the field. There are many different types of tripods, bipods, and even monopods ("stabilizers") appropriate to match shooting conditions and to provide helpful support and stabilization when acquiring a target. In many instances, stabilizers are mounted to a long gun and never removed.

Conventional stabilizers are typically not suited or designed for many different shooting applications and/or environments, e.g., some stabilizers may be designed for shooting from the prone position, while others are designed for shooting from the sitting, standing, or kneeling positions. It may be desirable, for example, to use a bipod when shooting from a prone position, but change to a taller tripod when shooting from a kneeling or standing position. Thus, some long gun users may wish to utilize different supports on the same firearm due to changes in the intended application, mission, or shooting environment.

Changing the support on a long gun can be a lengthy exercise and can pose equipment adjustment and tooling challenges. Installing bipods on a long gun, for example, may require tools and other special equipment and may require a gunsmith or armorer.

Some manufactures have devised various mounting bracket devices to provide a platform for mounting different shooting supports. Typically, these mounting brackets are rigidly and permanently attached to the forend of a firearm and supports can be attached or mounted to these brackets. Bipods are commonly attached to weapons using a screw-in stud. With advancing technologies these existing mounting brackets cannot accommodate supplemental or multiple supports. Because of the rigid attachments of the mounting bracket, there is no current capability to rapidly attach and detach a tandem mounting bracket to and from a weapon.

BRIEF SUMMARY OF EXEMPLARY EMBODIMENTS

Embodiments of the present invention provide an easily attachable and detachable mounting bracket that solves the above-discussed drawbacks. A detachable mounting bracket according to some embodiments of the present invention can be quickly installed and removed in the field by an end-user with or without simple hand tools. Also, a detachable mounting bracket according to some embodiments of the present invention enables users of various weapons platforms to rapidly and securely attach various monopods, bipods, and tripods ("supports") in tandem via a 1913 Picatinny Rail according to some embodiments. In other contemplated embodiments, the mounting bracket may be attachable to the weapon using a variety of mounting methods including, but not limited to, mounting to one or more QD (quick detachable) studs, a Rail Interface System, a Rail Accessory System, Weaver rails, and the like.

Generally described, a mounting bracket according to some embodiments of the present invention includes a main fixture coupled to side members that define a housing for encapsulating a portion of a weapon. One or more mounting adapters can be coupled to the fixture so that one or more supports can be attached to the bracket in tandem. Two side members can be adapted to be coupled together with a connection device so that the bracket is affixed to and securely attached to a weapon. Preferably, a connection device can be operated without tools enabling users to quickly attach the bracket to and remove the bracket from a weapon and/or support.

Detachable mounting bracket embodiments of the present invention can be attached to various weapons platforms using different methods. These different methods include, but are not limited to, a quick clamp method, a screw closure method, and a vertical interlock clamp. The embodiments of the present invention are discussed in more detail below with reference to the attached figures. It should be understood that the principles of the embodiments of the present invention can be utilized with many different types of firearms, guns, and weapons, including long guns.

DETAILED DESCRIPTION

Embodiments of the present invention provide a detachable firearm mounting bracket. The bracket can be easily attached to, and removed from, various weapons platforms, thus providing an easy to use mounting bracket for mounting monopods, bipods, tripods, and the like (collectively "supports"). The bracket also enables one or more supports to be attached to a weapon to aid a user in a wide range of environments. For example, the detachable mounting bracket device according to embodiments of the present invention enable users to rapidly attach supports to a shoulder-fired weapon (e.g., sniper rifle) so that the weapon can be used from virtually any position, e.g. prone, standing, kneeling, etc. In addition, users can quickly remove the support to adjust for a change in operational conditions using a detachable mounting bracket in accordance with the present invention.

Figure 1:
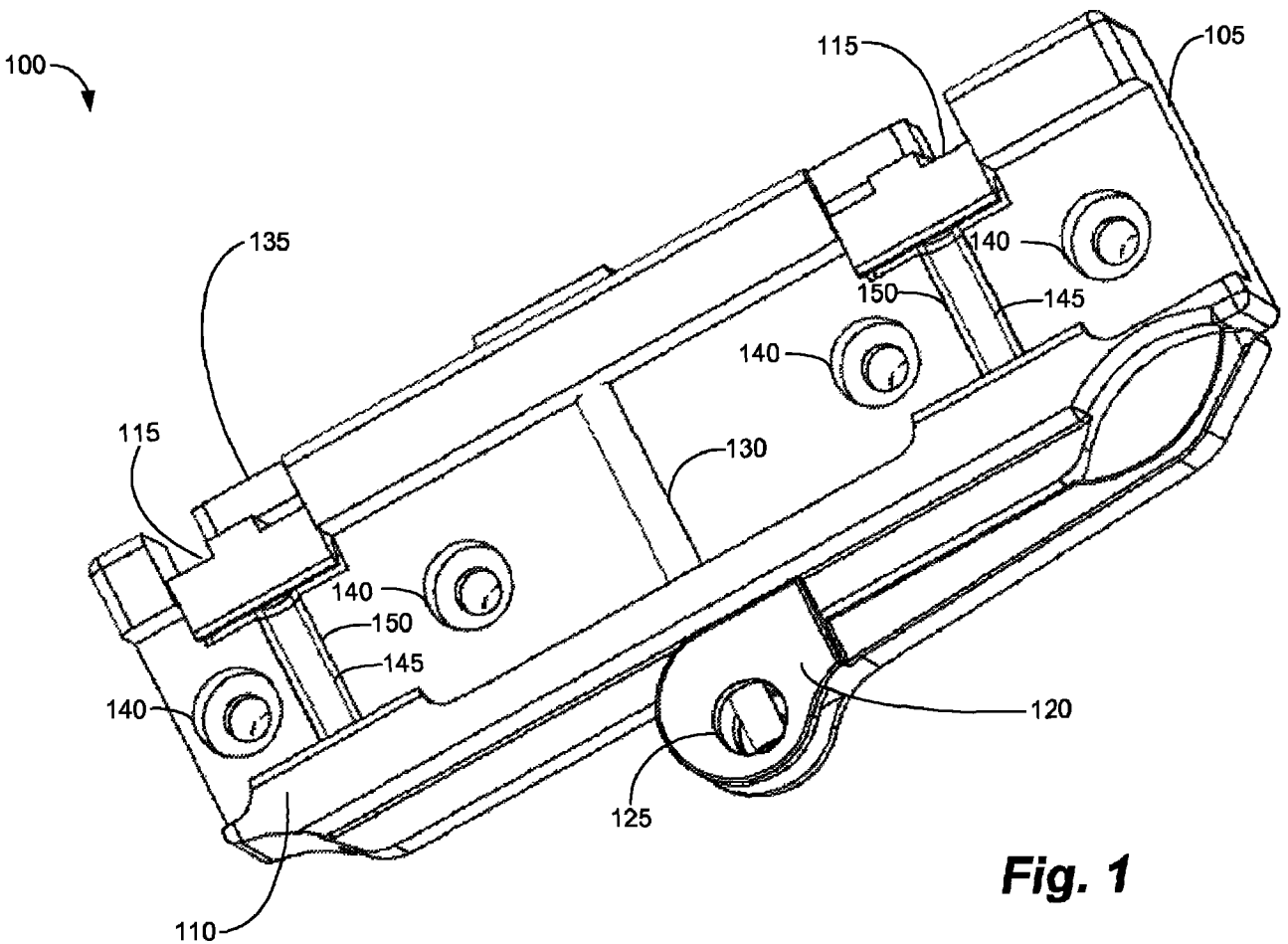
FIG. 1 illustrates a perspective, top view of a detachable tripod and bipod mounting bracket, in accordance with some embodiments of the present invention.

Referring now to the figures, FIG. 1 illustrates a perspective view of a detachable mounting bracket 100 to mount one or more supports to a weapon in accordance with an embodiment of the present invention. As shown, the mounting bracket 100 can encapsulate or partially surround a portion of a forend of a weapon. Preferably, the mounting bracket 100 is attachable to a 1913 Picatinny Rail. In other contemplated embodiments, the mounting bracket may be attachable to the weapon using a variety of mounting methods including, but not limited to, mounting to one or more QD (quick detachable) studs, a Rail Interface System, a Rail Accessory System, and Weaver rails. In alternative arrangements or configurations, the mounting bracket 100 can be attached to other portions of the weapon.

As shown in FIG. 1, the mounting bracket 100 can comprise several components. These components can include a main fixture 105, one or more first side members 110, a plurality of second side members 115, a cam locking lever 120, a cross axle hole 122, a cross axle 125, a fastener 130, a tensioning beam 135, a plurality of mounting holes 140, and a plurality of connectors 145. As shown, the first side members 110 and the second side members 115 are coupleable to the forend portion of the weapon. In accordance with a preferred embodiment of the present invention, the first side members 110 and second side members 115 can be "grabbers" coupleable to a rail attachment surface on a firearm, such as for example and not limitation, a Mil-Spec 1913 Picatinny rails mounted on the weapon. Those skilled in the art will understand that the 1913 Picatinny rail is a multipurpose interface rail used on firearms to provide a standardized mounting platform for many accessories, such as sights, scopes, tactical lights, laser sighting modules, and now supports. In other contemplated embodiments, however, the mounting bracket may be attachable to the weapon using a variety of mounting methods including, but not limited to, mounting to one or more QD (quick detachable) studs, a Rail Interface System, a Rail Accessory System, Weaver rails, and the like.

In an exemplary embodiment, the mounting bracket 100 further comprises a cam-locking lever 120 with a cross axle 125 disposed in a hole 122 in the cam-locking lever 120. A fastener, or cross bar, 130 preferably passes through the tensioning beam 135, the first side members 110, the cam-locking lever 120, and is attachable to the cross axle 125, which can be threaded. The cross bar 130 can be an Allen bolt, Torx bolt, threaded rod, or similar, although other fastening methods are contemplated.

The mounting bracket 100 preferably additionally comprises a plurality of connectors 145. The connectors 145 preferably connect the second side members 115 to the first side members 110 and the tensioning beam 135. The connectors 145 can be disposed in grooves or channels 150 disposed in the main fixture 105. The connectors 145 preferably provide axial alignment between the first side members 110 and the second side members 115. In some embodiments, the second side members 115 can further comprise a tab, or other means, to slideably engage the grooves 150. The tabs can provide additional axial alignment for the second side members 115. The connectors 145 can transmit the tension provided by the cross bar 130 via the tensioning beam 135 to the second side members 115. Finally, the connectors 145, in concert with cross bar 130, serve to locate the mounting bracket 100 longitudinally on the Picatinny rail of the weapon.

The cam-locking lever 120 preferably has a first position and a second position. In the first, or open, position the cam-locking lever 120 can be substantially perpendicular to the first side members 110 and in-line with the cross bar 130. In the first position, tension can be substantially removed from the tensioning beam 135 and thus, the second side members 115. This can allow the user to place the mounting bracket 100 into position on a Picatinny rail of the weapon.

In the second, or closed, position the cam-locking lever 120 can be substantially parallel to the first side members 110 and perpendicular to the cross bar 130. In this position, the camming action of the cam-locking lever 120 creates tension on the cross bar 130, and thus on the tensioning beam 135. The tensioning beam 135, in turn, exerts an inward force on the second side members 115 via the connectors 145. This can allow the user to position and secure the mounting bracket 100 in a desired location on the Picatinny rail of a weapon quickly and securely.

The mounting bracket 100 can be manufactured with various materials. For example, the mounting bracket 100 can be manufactured from a lightweight, high-tensile-strength aluminum. Alternative materials such as, for example and not limitation, titanium, steel, and polymer resin plastic may also be utilized. In addition, one or more materials can be used to manufacture the mounting bracket 100. Different materials can be used to provide a weight savings, increase mounting bracket 100 strength, and/or to vary mounting bracket 100 costs. In addition, the mounting bracket 100 can have an anodized or hard-anodized finish. In some embodiments, the connectors 145, cross bar 130, cam-locking lever 120 and/or cross axle 125 may be replaced by standard machine bolts and nuts. This can reduce cost, though some functionality may be lost (e.g., toolless removal).

In the field, it may be desirable for a user to be able to quickly transition from a prone to a standing shooting position. This, in turn, can require the user to transition from a prone-style bipod to a taller tripod, preferable for shooting from the standing position. Conventionally, this would have taken a considerable amount of time. For example, a Harris bipod is commonly used for shooting from the prone or sitting position. The Harris bipod is typically mounted to a weapon using a factory installed sling stud. On the other hand, a tripod can be mounted using a commercial Manfrotto-style or other quick release adapter. While both solutions offer quick attachment/detachment of their respective supports, they require individual mounting solutions.

Figure 2:
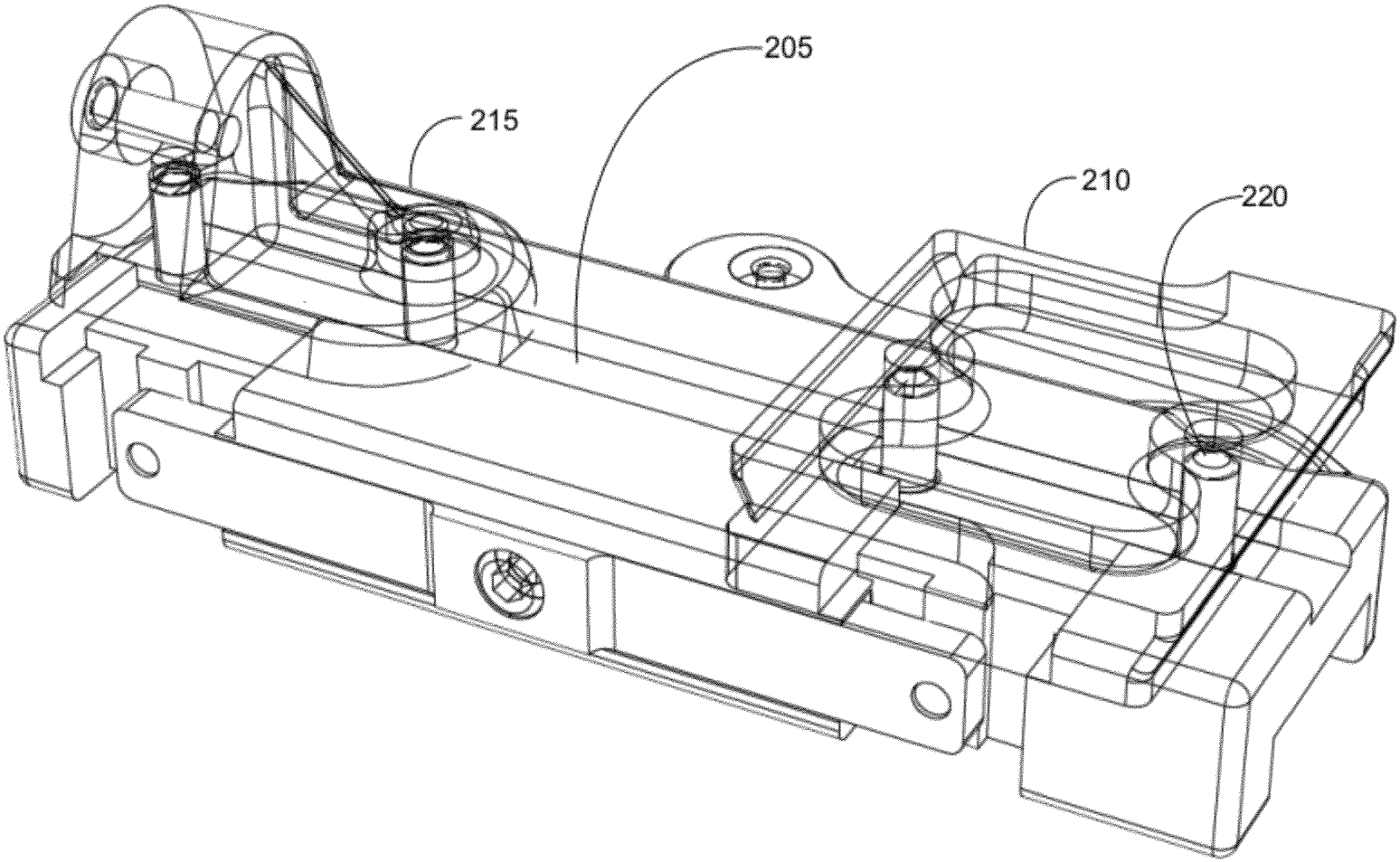
FIG. 2 illustrates a perspective, bottom view of a detachable tripod and bipod mounting bracket, in accordance with some embodiments of the present invention.

Therefore, in an exemplary embodiment, the mounting bracket 100 can allow the user to install a variety of supports and other accessories by simply using the correct adapter on a common bracket 100. The mounting bracket 100 can preferably comprise an adapter mounting groove 205 and a plurality of mounting holes 140. See FIG. 2. Mounting bracket adapters are preferably mounted using a plurality of fasteners 220 and aligned using the adapter mounting groove 205. A close tolerance between the adapter mounting groove 205 and the accessory mounting adapters 210, 215, can provide precise alignment for a variety of accessory mounting adapters.

Figure 3:
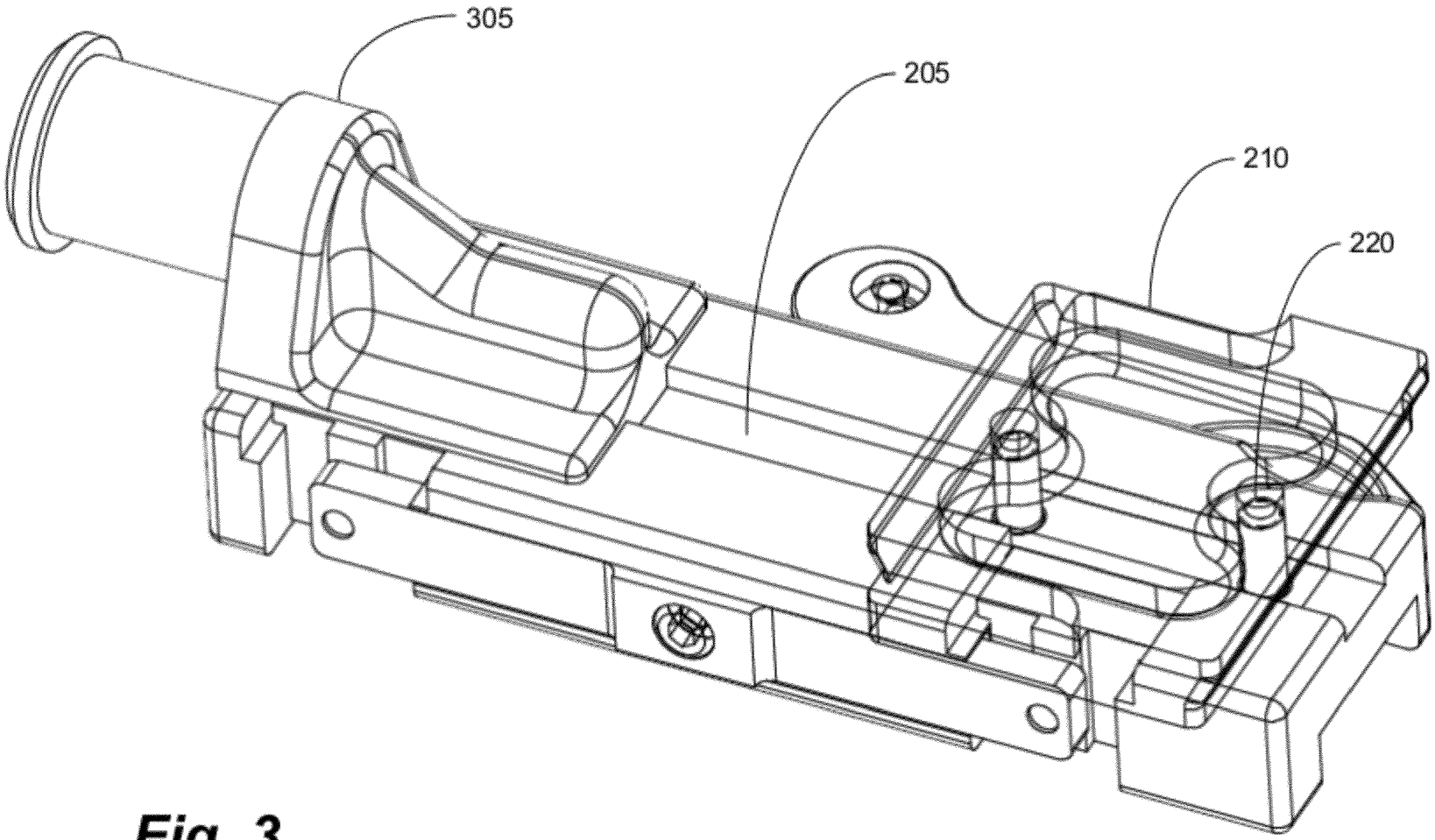
FIG. 3 illustrates a perspective, bottom view of a detachable tripod and bipod mounting bracket with an alternative mounting adapter, in accordance with some embodiments of the present invention.
Figure 4:
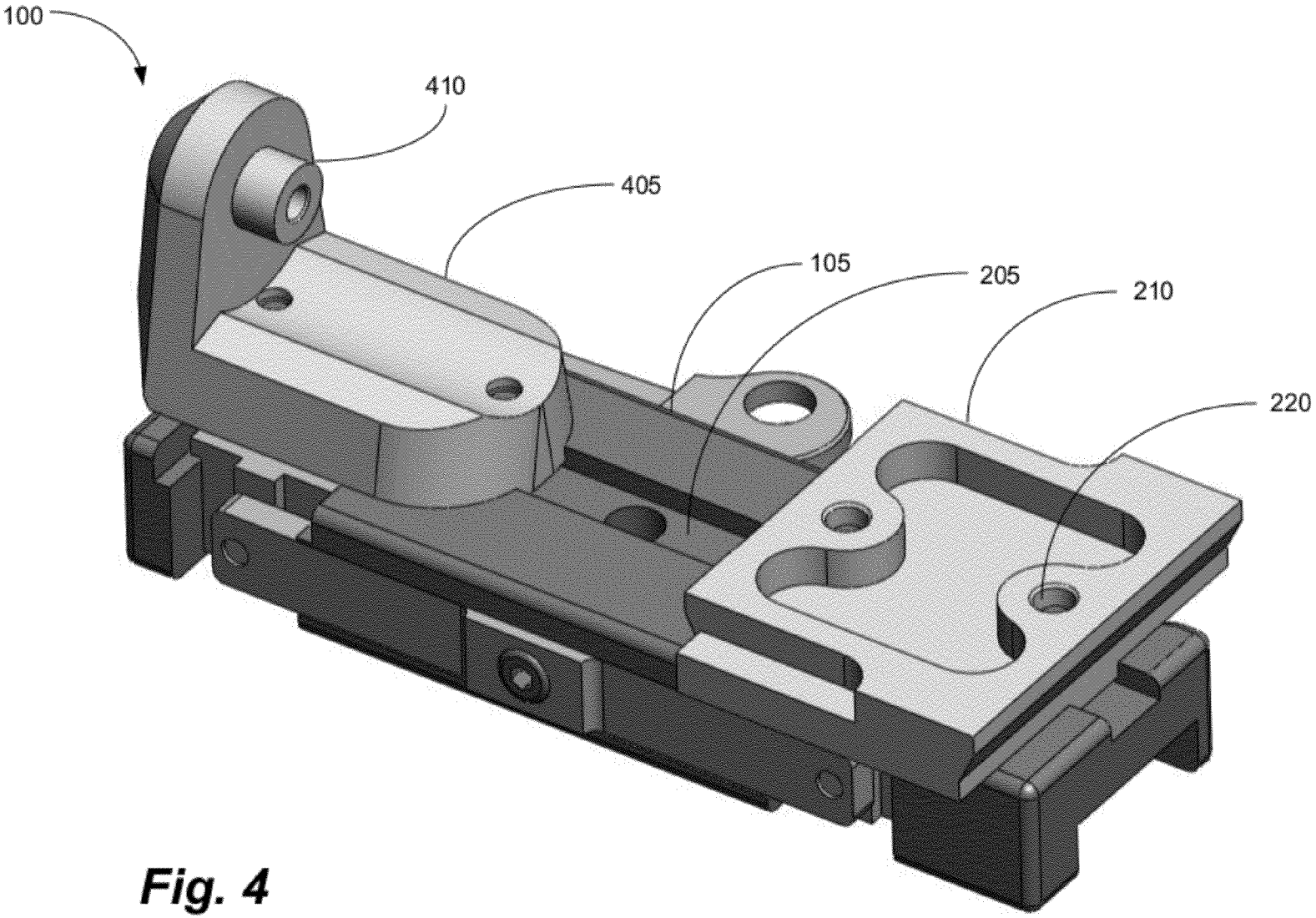
FIG. 4 illustrates a perspective view of the detachable tripod and bipod mounting bracket with a second alternative mounting adapter, in accordance with some embodiments of the present invention.

In an exemplary embodiment, the mounting bracket 100 can simultaneously mount a Manfrotto-type tripod and a Harris style bipod. Other types of bipods and tripods, for example, can also be mounted using appropriate adapters 210 and 215. In an alternative embodiment, the mounting bracket 100 can mount the commercial Manfrotto-type tripod and an M14 style bipod, simply by changing to the appropriate adapter 305. See FIG. 3. Therefore, if the shooter needs to transition from one shooting position to another, he can quickly remove one support and attach another because necessary adapters for both supports were previously installed in tandem. In an alternative embodiment, many combinations of accessory mounting adapters are envisioned to suit specific operational needs.

In some embodiments, it may be desirable to mount various mounting adapters in different orientations based on user preference or space requirements. Mounting a Harris-type bipod adapter 405 with the attachment lug 410 facing the user, for example, can place the controls for the bipod closer to the user. In this configuration, the user can adjust the level of the bipod, for example, more easily because the controls are facing the user and are not obscured by the mounting adapter 405. The modularity of the mounting bracket 100 enables accessory mounting adapters to be mounted to the main fixture 105 in a variety of orientations.

Figure 5A:
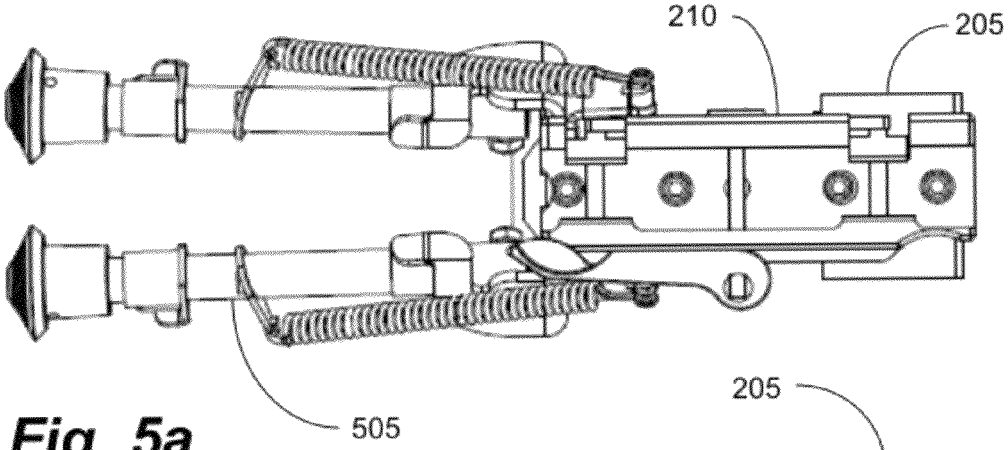
FIGS. 5*a*-5*c* illustrate a bottom, side, and top view, respectively, of the detachable tripod and bipod mounting bracket with a Harris-type bipod and a Manfrotto-type adapter installed, in accordance with some embodiments of the present invention.
Figure 5B:
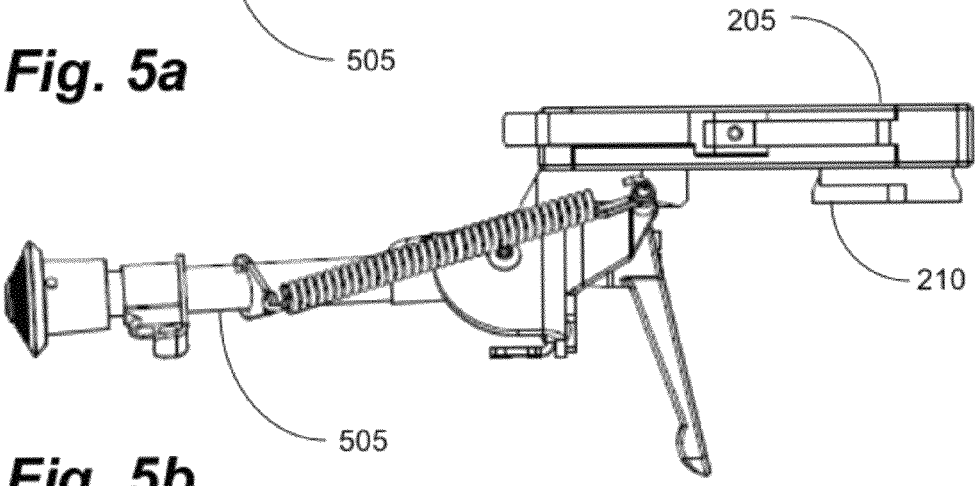
Figure 5C:
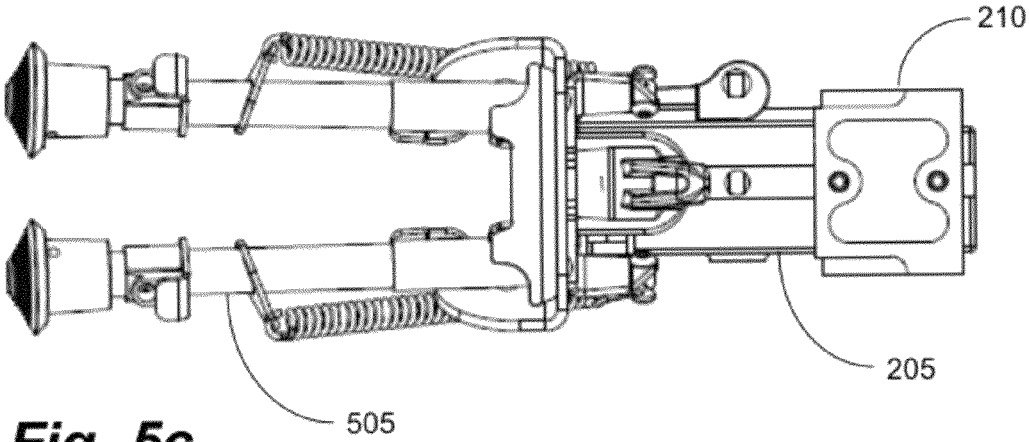

As shown in FIGS. 5*a*-5*c*, the mounting bracket 100 can enable a Harris-type bipod 505 to be mounted on a first end and a Manfrotto-type adapter to be mounted on a second end. The bipod 505 is shown in the folded position, enabling the user to use a different support on an additional adapter 210 without removing the bipod 505. In use, if the user wishes to convert from, for example, a prone position using the bipod 505 to a standing position using a tripod, the user has only to fold the bipod 505 and attach the firearm to, for example, a tripod using the quick release Manfrotto-type adapter 210. This can enable the user to convert from one support to the other and back in a matter of second in response to changing tactical conditions.

Mounting bracket embodiments of the present invention can allow a variety of supports to be attachable to the forend of a long gun, preferably using a 1913 Picatinny rail. The bracket embodiments of the present invention can also be attached to a broad range of other weapons platforms. These include, but are not limited, handguns, air rifles, sporting rifles, shotguns, handguns, less-than-lethal weapons (e.g., physical projectile, chemical agent, baton, sound, light, laser, net, etc.), military combat rifles, individual shoulder fired weapons, crew served weapons, anti-armor weapons, water cannons, and high intensity visible and IR Light Sources.

The bracket embodiments of the present invention can also be used to attach a broad range of additional accessories to a weapons platform including, but not limited to, field optical devices. The range of these devices includes electro-optic devices and sensor and visual augmentation devices. These optic field devices can include, but are not limited to, thermal imagers, night vision, cameras, visible light illuminators, infrared illuminators, aiming devices, and laser target pointers and designators. Still yet other field optical devices include binoculars, spotting scopes, telescopes, rifle scopes, laser range finders, video cameras, and closed circuit television cameras (CCTV).

While the various embodiments of this invention have been described in detail with particular reference to exemplary embodiments, those skilled in the art will understand that variations and modifications can be effected within the scope of the invention as defined in the appended claims. Accordingly, the scope of the various embodiments of the present invention should not be limited to the above discussed embodiments, and should only be defined by the following claims and all equivalents.

We claim:

1. A detachable mounting bracket comprising:

a main fixture comprising a top side and a bottom side, the top side comprising a first edge and an opposing second edge and the bottom side of the main fixture defining an adapter groove and one or more mounting holes disposed within the adapter groove;

one or more first side members disposed proximate the first edge of the main fixture;

two or more second side members disposed proximate, and slideably engaged with, the second edge of the main fixture;

a tensioning beam connecting the two or more second side members; and a tensioner disposed proximate the first edge of the main fixture and connected to the tensioning beam with a first, open position and second, closed position;

one or more mounting adapters configured to mount one or more support devices;

wherein the tensioner pulls the tensioning beam toward the one or more first side members when moved between the first position and the second position; and wherein the one or more mounting adapters are slideably engaged with the adapter groove and threadably engaged with the one or more mounting holes.

2. The detachable mounting bracket of claim 1, the tensioner further comprising:

a cam locking lever with a first end and a second end; and a cam disposed on the second end of the cam locking lever;

wherein the cam pulls the two or more second side members toward the one or more first side members when moved from the first position to the second position; and wherein the second position corresponds to a first detent position on the cam.

3. The detachable mounting bracket of claim 2, wherein the first position corresponds to a second detent position on the cam.

4. The detachable mounting bracket of claim 1, wherein the first and second side members comprise graspers sized and shaped to grasp a rail mounting surface.

5. The detachable mounting bracket of claim, wherein the rail mounting surface comprises one of a Picatinny rail and a Weaver rail.

6. A detachable mounting bracket for mounting to an accessory rail comprising:

a main fixture comprising:

a top side comprising a first edge and an opposing second edge and defining one or more alignment grooves;

one or more first side members disposed on the first edge; and a bottom side defining an adapter groove;

two or more second side members disposed on the second edge of the top side;

a tensioning beam spanning the two or more second side members;

one or more fasteners disposed in, and slideably engaged with, the one or more alignment grooves for detachably connecting the tensioning beam to the one or more second side members; and a tensioner, disposed on the first edge of the main fixture and connected to the tensioning beam, with a first, open position and a second, closed position;

wherein the tensioner pulls the tensioning beam toward the one or more first side members when moved from the first position to the second position.

7. The detachable mounting bracket of claim 6, the tensioner comprising:

a cam locking lever, comprising a first end and a second end, the second end defining a cross axle hole and being a substantially cam shaped;

a cross axle disposed in the cross axle hole; and a cross bar connecting the cross axle and the tensioning beam;

wherein, in a first, open position, space exists between the first and second side members such that the detachable mounting bracket is removable from the accessory rail; and wherein, in a second, closed position, the first and second side members grasp the accessory rail such that the detachable mounting bracket is fixed on the accessory rail.

8. The detachable mounting bracket of claim 6, the main fixture further defining one or more mounting holes for detachably affixing one or more mounting adapters to the main fixture.

9. The detachable mounting bracket of claim 6, the second side members further comprising tabs for slideably engaging the one or more alignment grooves.

10. The detachable mounting bracket of claim 6, wherein the main fixture and the one or more first side members are an integral component.

11. The detachable mounting bracket of claim 6, wherein the tensioning bar and the two or more second side members are an integral component.

* * * * *